United States Patent [19]

Nooden

[11] 4,443,259

[45] Apr. 17, 1984

[54] COATING FOR FOUNDRY CORES AND MOLDS

[75] Inventor: Robert A. Nooden, Terre Haute, Ind.

[73] Assignee: International Minerals & Chemical Corp., Terre Haute, Ind.

[21] Appl. No.: 449,098

[22] Filed: Dec. 10, 1982

[51] Int. Cl.[3] ..... B28B 7/36

[52] U.S. Cl. ..... 106/38.27; 164/14; 427/134; 501/122; 501/141

[58] Field of Search ..... 106/38.22, 38.27, 38.9; 164/14; 427/134; 501/122, 141

[56] References Cited

U.S. PATENT DOCUMENTS 4,303,700 12/1981 Adams et al. ..... 106/38.27

OTHER PUBLICATIONS

Dietert, H. W.: "Foundry Core Practice", American Foundrymen's Society, pp. 1, 2, 332–337, 343–345, 1950.

Anonymous: "Understanding Core and Mold Coatings", Modern Casting, p. 59, Sep. 1981.

Anonymous: "Molding Methods and Materials", American Foundrymen's Society, pp. 1, 161–164, 1962.

*Primary Examiner*—Lorenzo B. Hayes

*Attorney, Agent, or Firm*—Robert H. Dewey

[57] ABSTRACT

A coating for foundry cores and molds comprising an aqueous suspension of clay, olivine, and sodium tripolyphosphate.

6 Claims, No Drawings

COATING FOR FOUNDRY CORES AND MOLDS

This invention relates to improved coatings for foundry cores and molds. In a particular aspect, this invention relates to improved coatings containing olivine.

Coatings (also known as washes) for foundry cores and molds are basically mold-release agents used in the foundry industry to promote release of metal castings from cores and molds, which are made from sand or other aggregate. They are used to give smoother casting surfaces with fewer defects thereby reducing expense and time in the cleaning room.

In its simplest form, such a coating is simply a suspension of clay, e.g. bentonite, in water which is prepared by circulating the mixture through a pump for about four hours to obtain a good dispersion. However, it is also known to use additional ingredients such as silica, mica, zircon flour, magnesite, olivine, talcs or mixtures of these. Western bentonite is one of the most important of these raw materials. While the use of these materials has been successful, various problems occur. For example, silica causes environmental pollution problems. Olivine is an attractive replacement for silica, but olivine-clay suspensions exhibit different rheological characteristics than silica-based ones. Also, these characteristics may differ depending on the origin of the olivine and any pretreatment it may receive. For example, North Carolina olivine produces a wash which exhibits non-Newtonian viscosity and requires a greater force to produce initial flow than the silica wash. After adding a surfactant, however, the difference in force required decreases considerably. On the other hand, calcined olivine does not produce the non-Newtonian viscosity characteristic, and uncalcined olivine leached with water behaves the same as calcined. Washington (state) olivine behaves the same as raw North Carolina olivine regardless of whether it is raw or calcined.

Obviously such variability is objectionable to the foundryman. Accordingly, there is a need for a method of stabilizing the rheological characteristics of core and mold washes based on olivine and clay.

SUMMARY OF THE INVENTION

It is an object of this invention to provide improved coatings for foundry cores or molds.

It is another object of this invention to provide a method for improving the performance of core and mold coatings based on olivine.

Other objects of this invention will be apparent to those skilled in the art from the disclosure herein.

It is the discovery of this invention to provide an improved, water-based coating for cores and molds for the foundry industry. The improved coating, or wash, comprises an aqueous suspension of clay, olivine and sodium tripolyphosphate (STPP). The invention also provides for a method of stabilizing viscosity and rheological characteristics of aqueous clay-olivine suspensions.

DETAILED DISCUSSION

Coatings for cores and molds are prepared by a variety of formulae, depending on the metal to be cast. Aqueous suspensions may be as simple as 150 parts by weight of silica and 12 parts of bentonite in sufficient water to provide the viscosity desired. Another typical formula calls for 4 parts of bentonite, 15 parts of kaolin and 150 parts of silica. In these and other formulae, the silica can be replaced with olivine on an equal weight basis and from 0.001 to 1.0% STPP is added, based on the weight of the total formula.

The core wash of the present invention can be provided by a dry mixture of the solid ingredients which is then mixed with water at the place of use, or it can be provided as a completed aqueous suspension. Preferably, when the dry ingredients are mixed with water, it is mixed mechanically to insure that the dry ingredients are thoroughly wetted and free from all bubbles, as is well known in the art. Colloidal clay requires an appreciable length of time to reach its water saturation point, as is known, and mechanical mixing greatly reduces the time interval.

The coating can be applied to the core or mold by any means known in the arts, e.g. by spraying, dipping or brushing. The coating is dried before use by any known method, e.g. by passing the coated cores through a drying oven, by applying the wash while the cores are hot or by air drying.

Clays used in the practice of this invention can be any of the clays previously known to be useful in the art of preparing core and mold washes. Such clays include but are not limited to the bentonites, kaolin and other members of the montmorillonite group. It is understood that the practice of this invention is not limited to any particular clay. Generally the amount of clay used will be in the range of 1–5% by weight based on the total weight of the suspension.

Olivine used in the practice of this invention is a natural mineral consisting of a solid solution rich in magnesium orthosilicate (Fosterite) with a minor amount of ferric orthosilicate (Fayalite). Olivine is a major component of dunite rock. Typically, olivine has a composition falling within the following general ranges:

| | |
|---|---|
| MgO | 40–52% by weight |
| $SiO_2$ | 35–45% by weight |
| FeO | 6.5–10% by weight |
| $Al_2O_3$, $K_2O$, $Na_2O$ | Trace |

Any olivine falling within the above ranges is suitable for the practice of this invention. In the United States, olivine is principally mined in the states of Washington and North Carolina. Also, olivine is sometimes calcined, i.e. heated to an elevated temperature, before use. The invention is not limited to olivine from any particular source, as any olivine can be used, and it can be either calcined or uncalcined. Generally the olivine is used in an amount of from about 25–75% based on the total weight of the suspension.

Surfactants may be used in these coatings if desired. Useful surfactants are known in the art and form no part of this invention. Sodium lauryl sulfate is a widely used surfactant. Usually the surfactant is added as a concentrated aqueous solution after the solid ingredients are well mixed with the water portion.

The invention will be better understood by referring to the following examples. It is understood, however, that these examples are intended only to illustrate the invention and it is not intended that the invention be limited thereby.

EXAMPLE 1

A suspension of clay in water was prepared by adding 143.7 g of Western bentonite to 3 kg of deionized water. The mixture was stirred for one hour, then bottled and aged for at least two days or more before use. This suspension was used as a stock solution for all of the examples.

To prepare mold wash for experimental purposes, the clay suspension was shaken well and 437.6 g were weighed into a stainless steel beaker, 5" in diameter and having a 2-liter capacity. To this was added 806.6 g of olivine flour with stirring. Stirring was continued for one hour and the mixture was then transferred to a stainless steel beaker, 4" in diameter having a capacity of 1 liter.

The viscosity of test solutions was determined using a Stormer paint testing viscosimeter. This instrument, which is known in the art, consists of a small paddle. The paddle is turned by means of a falling weight and the time is recorded for a predetermined number of revolutions. This time measurement is recorded for a series of incrementally increasing weights. The data—revolutions per second vs weight—is plotted as rate of shear vs stress. The viscosity is the inverse of the slope of the curve thereby obtained. If it is linear, the viscosity is said to be Newtonian and if non-linear, it is non-Newtonian. The data below were read from the curves.

Sodium tripolyphosphate (STPP) was added to the clay-olivine suspension in an amount to provide 0.08% of sodium based on the total weight of the wash (0.178% STPP) and the rate of shear with respect to stress was determined. The following values were obtained:

| | Rate of Shear | |
|---|---|---|
| Stress, g | Without STPP | With STPP |
| 50 | — | 1.4 |
| 100 | — | 2.4 |
| 150 | — | 3.2 |

-continued

| | Rate of Shear | |
|---|---|---|
| Stress, g | Without STPP | With STPP |
| 200 | — | 4.0 |
| 250 | — | 4.6 |
| 300 | — | 5.2 |
| 350 | 3.5 | 5.7 |
| 400 | 5.0 | 6.2 |
| 450 | 5.8 | 6.6 |
| 500 | 6.6 | 7.0 |
| 550 | 7.1 | 7.2 |
| 600 | 7.7 | 7.6 |

Although the curves obtained were non-linear, the curve obtained with STPP was much more nearly so than without.

It was concluded that the addition of 0.178% STPP greatly improved the viscosity characteristics of the wash. The wash is used on a mold for a casting. The resulting casting is smooth and of high quality.

EXAMPLE 2

The experiment of Example 1 was repeated in all essential details except that a series of washes was prepared containing amounts of sodium tripolyphosphate to give sodium levels of 0.01, 0.02, 0.04 and 0.08%, corresponding to 0.022, 0.044, 0.089% STPP respectively. As little as 0.022% of STPP was sufficient to reduce non-Newtonian characteristics.

I claim:

1. A coating for foundry cores and molds comprising an aqueous suspension of clay, olivine, and sodium tripolyphosphate.

2. The composition of claim 1 wherein the clay is present in an amount of 1 to 5%.

3. The composition of claim 1 wherein the clay is bentonite.

4. The composition of claim 1 wherein the olivine is present in an amount of 25 to 75%.

5. The composition of claim 4 wherein the origin of the olivine is the states of Washington or North Carolina.

6. A method for stabilizing an aqueous suspension of clay and olivine comprising adding thereto from 0.01 to 1.0% of sodium tripolyphosphate.

* * * * *